US005570173A

United States Patent [19]

Nye et al.

[11] Patent Number: 5,570,173

[45] Date of Patent: Oct. 29, 1996

[54] COLOR PRINTER USING LIQUID DEVELOPER

[75] Inventors: LeRoy M. Nye, Penfield; Henry R. Till, East Rochester; James R. Larson, Fairport, all of N.Y.

[73] Assignee: Xerox Corporation, Stamford, Conn.

[21] Appl. No.: 331,855

[22] Filed: Oct. 31, 1994

[51] Int. Cl.[6] ..... G03G 15/01; G03G 15/10

[52] U.S. Cl. ..... 355/326 R; 355/256

[58] Field of Search ..... 355/256, 257, 355/326 R, 327

[56] References Cited

U.S. PATENT DOCUMENTS

| | | | |
|---|---|---|---|
| 4,161,360 | 7/1979 | Smith | 355/256 |
| 4,684,238 | 8/1987 | Till et al. | 355/256 X |
| 4,690,539 | 9/1987 | Radulski et al. | 355/256 X |
| 4,994,858 | 2/1991 | Lubberts | 355/327 X |
| 5,132,743 | 7/1992 | Bujese et al. | 355/274 |
| 5,150,161 | 9/1992 | Bujese | 355/256 |
| 5,176,974 | 1/1993 | Till et al. | 430/42 |
| 5,189,477 | 2/1993 | Leys et al. | 355/271 |
| 5,332,642 | 7/1994 | Simms et al. | 430/125 |
| 5,342,715 | 8/1994 | Kamath et al. | 355/327 X |
| 5,408,299 | 4/1995 | Haas | 355/256 |
| 5,424,813 | 6/1995 | Schlueter et al. | 355/256 |

*Primary Examiner*—Fred L. Braun
*Attorney, Agent, or Firm*—Lloyd F. Bean, II

[57] ABSTRACT

A color printer having a photoconductive belt and employing liquid developer. A latent image is recorded on the photoconductive belt corresponding to the subtractive color of one of the colors of the appropriately colored toner particles at a first development station. An image conditioning system condition the developed image by reducing fluid content while inhibiting the departure of toner particles therefrom thereby increasing solids content of the developed image on the photoconductive belt. The photoconductive surface with the developed image thereon is recharged and re-exposed to record the latent image thereon corresponding to the subtractive primary of another color of the original. This latent image is developed with appropriately colored toner and conditioned. This process is repeated until all the different color toner layers are deposited in superimposed registration with one another on the photoconductive surface. The multi-layered toner image is transferred from the photoconductive surface to an intermediate belt for further conditioning and thereafter is transferred to a copy sheet.

8 Claims, 1 Drawing Sheet

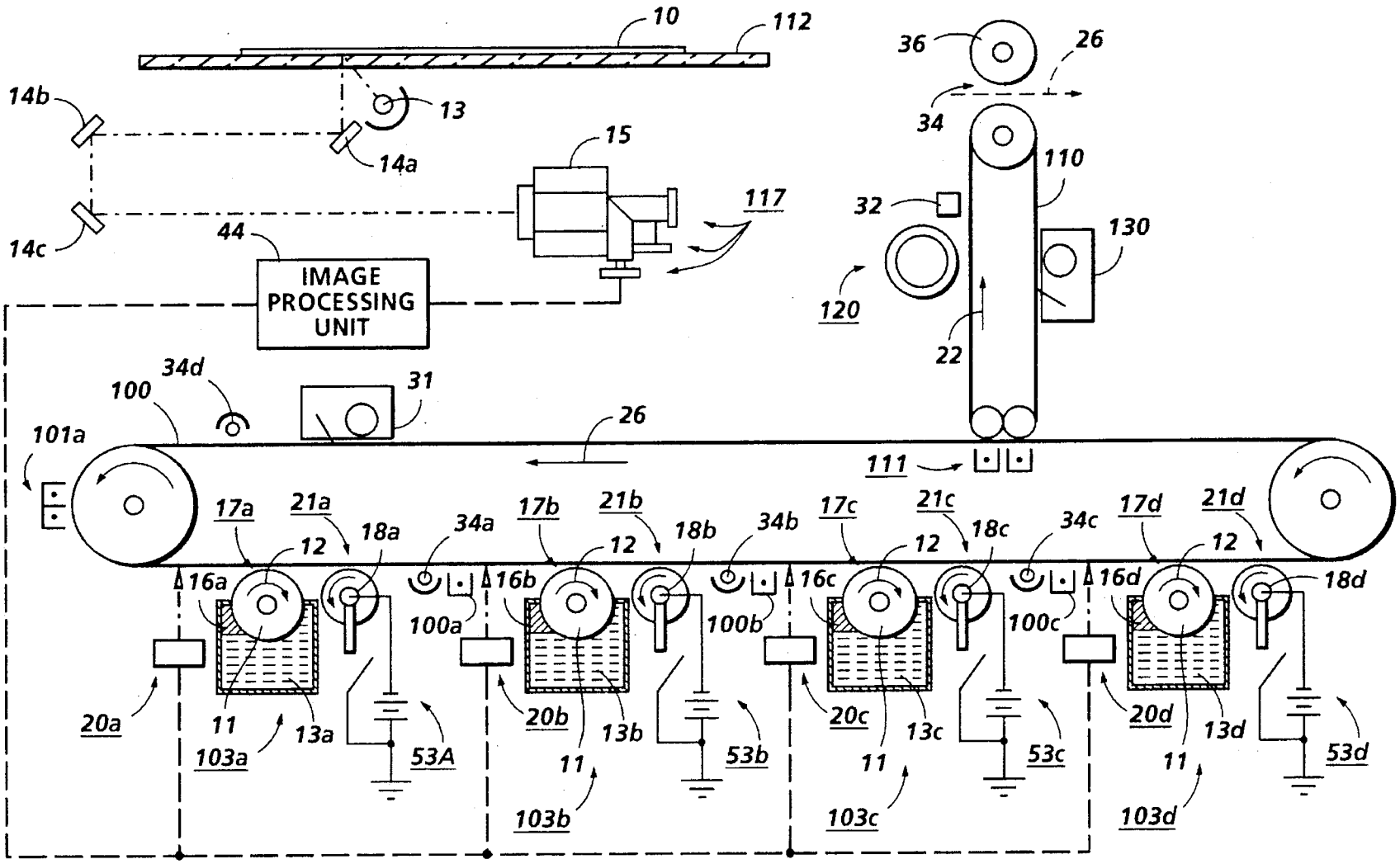
IMAGE PROCESSING UNIT

COLOR PRINTER USING LIQUID DEVELOPER

FIELD OF THE INVENTION

This invention relates generally to an electrophotographic printing machine, and, more particularly, concerns a method and apparatus for reproducing color images on the electrophotographic printing machine with liquid developer.

BACKGROUND OF THE INVENTION

The quality or acceptability of a color copy is a function on how the human eye and mind receives and perceives the colors of the original and compares it to the colors of the copy. The human eye has three color receptors that sense red light, green light, and blue light. These colors are known as the three primary colors of light. These colors can be reproduced by one of two methods, additive color mixing and subtractive color mixing, depending on the way the colored object emits or reflects light.

In the method of additive color mixing, light of the three primary colors is projected onto a white screen and mixed together to create various colors. A well known exemplary device that uses the additive color method is the color television. In the subtractive color method, colors are created from the three colors yellow, magenta and cyan, that are complementary to the three primary colors. The method involves progressively subtracting light from white light. Examples of subtractive color mixing are color photography and color printing. Also, it has been found that electrophotographic printing machines are capable of building up a full subtractive color image from cyan, magenta, yellow and black. They can produce a subtractive color image by one of three methods. One method is to transfer the developed image of each color on an intermediary, such as a belt or drum, then transferring all the images superimposed on each other on a sheet of copy paper. A second method involves developing and transferring an image onto a sheet of copy paper, then superimposing a second and subsequent images onto the same sheet of copy paper. For example, U.S. Pat. No. 4,953,012 discloses an image processing system which can produce a color image by developing the image on a photoconductive surface and transferring an image onto a sheet of copy paper, then superimposing a second and subsequent images onto the same sheet of copy paper.

The third method utilizes the Recharge, Expose, and Develop (REaD) process. In this process, the light reflected from the original is first converted into an electrical signal by a raster input scanner (RIS), subjected to image processing, then reconverted into a light, pixel by pixel, by a raster output scanner (ROS) which exposes the charged photoconductive surface to record a latent image thereon corresponding to the substractive color of one of the colors of the appropriately colored toner particles at a first development station. The photoconductive surface with the developed image thereon is recharged and re-exposed to record the latent image thereon corresponding to the subtractive primary of another color of the original. This latent image is developed with appropriately colored toner. This process (REaD) is repeated until all the different color toner layers are deposited in superimposed registration with one another on the photoconductive surface. The multi-layered toner image is transferred from the photoconductive surface to a sheet of copy paper. Thereafter, the toner image is fused to the sheet of copy paper to form a color copy of the original. For example, U.S. Pat. No. 4,403,848, U.S. Pat. No. 4,599, 285, U.S. Pat. No. 4,679,929, U.S. Pat. No. 4,791,455, U.S. Pat. No. 4,809,038, U.S. Pat. No. 4,833,504, U.S. Pat. No. 4,927,724, U.S. Pat. No. 4,941,003, U.S. Pat. No. 4,949,125, U.S. Pat. No. 5,023,632, U.S. Pat. No. 5,066,989 and U.S. Pat. No. 5,079,155 discloses various methods of forming color copies using dry toners, where a first image is formed and developed on a photoconductive surface, the steps above are repeated to superimpose a plurality of toner images on the photoconductive surface, and the toner images is transferred on a copy sheet by one step.

The use of liquid developers in imaging processes is known. For example, U.S. Pat. No. 3,843,538 discloses a developer emulsion comprising a disperse water phase and a continuous phase which is a solution of a pigmented high molecular weight polymer dissolved in an appropriate organic solvent. The emulsion is non-conductive, and may also be stabilized by a surface-active emulsifying agent with a predetermined hydrophilic-lipophilic balance. The liquid component of the emulsion is a solution of polymer resins in an organic solvent of about 90 percent Isopar® G and 10 percent aromatic hydrocarbons. A release agent, such as polyethylene wax, may be added to assist image transfer. The aqueous component allows for reduction in the amount of isoparaffin solvent which must be evaporated from the photoconductor after transfer. In addition, U.S. Pat. No. 4,659,640, the disclosure of which is totally incorporated herein by reference, discloses a liquid developer containing a volatile liquid carrier, wax, and polyester toner particles. The developer is self-fixing at room temperature as a result of the high wax concentration. Isopar® G is a preferred liquid carrier, and Epolene is a preferred polyethylene wax.

Liquid developers have many advantages, and often result in images of higher quality than images formed with dry toners. For example, images developed with liquid developers can be made to adhere to paper without a fixing or fusing step, so there is no need to include a resin in the liquid developer for fusing purposes. In addition, the toner particles can be made very small without resulting in problems often associated with small particle powder toners, such as machine dirt which can adversely affect reliability, potential health hazards, limited crushability, and restrictions against the use of coarsely textured papers. Development with liquid developers in full color imaging processes also has many advantages, such as a texturally attractive print because there is substantially no height build-up, whereas full color images developed with dry toners often exhibit height build-up of the image where color areas overlap. In addition, full color imaging with liquid developers is economically attractive, particularly if the liquid vehicle containing the toner particles can be recovered economically and without cross contamination of colorants. Further, full color prints made with liquid developers can be made to a uniformly glossy or a uniformly matte finish, whereas uniformity of finish is difficult to achieve with powder toners because of variations in the toner pile height, the need for thermal fusion, and the like.

When full color images are formed by sequential imaging and development with different colored developers as described in the third method, the ability to maintain consistency of hue in the final image using dry toners depends, in part, in maintaining a substantially constant relationship between exposure and developed mass per area for each color toner layer on photoconductive surface and upon achieving good registration of the several primary color images needed to form the composed color image.

In this process, achieving multiple registering images onto the photoconductive surface with liquid toner is difficult. Generally, liquid images tend to smear and intermingle with one another, distorting and blurring of the full color image. The apparatus and process of the present invention provide a means for forming full color images with excellent registration, thus avoiding the difficulties encountered with many prior art processes.

SUMMARY OF THE INVENTION

In accordance with one aspect of the present invention, there is provided an electrophotographic printing machine for producing an image on a recording sheet, comprising a photoconductive member. First means are provided for charging the photoconductive member. First means are provided for exposing the charged photoconductive member for recording an electrostatic latent image thereon. First means are provided for developing the electrostatic latent image with liquid developer material containing toner particles of a first color to form a developed image on the photoconductive member. Second means are provided for charging the developed image on the photoconductive member. Second means are provided for exposing the charged developed image on the photoconductive member. And, second means are provided for developing the developed image with liquid developer material containing toner particles of a second color to form a composite image on the photoconductive member.

DESCRIPTION OF THE DRAWINGS

Other aspects of the present invention will become apparent as the following description proceeds and upon reference to the drawings, in which:

FIG. 1 is a schematic, elevational view of a color electrophotographic printing machine that incorporates the adaptive processing unit of the present invention therein;

While the present invention will be described in connection with a preferred embodiment and method of use thereof, it will be understood that it is not intended to limit the invention to that embodiment or method of use. On the contrary, it is intended to cover all alternatives, modifications and equivalents that may be included within the spirit and scope of the invention as defined by the appended claims.

DETAILED DESCRIPTION OF THE INVENTION

For a general understanding of the features of the present invention, reference numerals have been used throughout to designate identical elements. FIG. 1 schematically depicts the various elements of an illustrative color electrophotographic printing machine incorporating the present invention therein. It will become evident from the following discussion that the present invention is equally well suited for use in a wide variety of printing machines and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

Turning now to FIG. 1, there is shown a color document imaging system incorporating the present invention. The color copy process can begin by either inputting a computer generated color image into the image processing unit 44 or by way of example, placing a color document 10 to be copied on the surface of a transparent platen 112. A scanning assembly consisting of a halogen or tungsten lamp 13 which is used as a light source, and the light from it is exposed onto the color document 10; the light reflected from the color document 10 is reflected by the 1st, 2nd, and 3rd mirrors 14*a*, 14*b* and 14*c*, respectively, then the light passes through lenses (not shown) and a dichroic prism 15 to three charged-coupled devices (CCDs) 117 where the information is read. The reflected light is separated into the three primary colors by the dichroic prism 15 and the CCDs 117. Each CCD 117 outputs an analog voltage which is proportional to the intensity of the incident light. The analog signal from each CCD 117 is converted into an 8-bit digital signal for each pixel (picture element) by an analog/digital converter. The digital signal enters an image processing unit 44. The digital signals which represent the blue, green, and red density signals are converted in the image processing unit into four bitmaps: yellow (Y), cyan (C), magenta (M), and black (Bk). The bitmap represents the value of exposure for each pixel, the color components as well as the color separation. Image processing unit 44 may contain a shading correction unit, an undercolor removal unit (UCR), a masking unit, a dithering unit, a gray level processing unit, and other imaging processing sub-systems known in the art. The image processing unit 44 can store bitmap information for subsequent images or can operate in a real time mode.

The photoconductive member, preferrably a belt of the type which is typically multilayered and has a substrate, a conductive layer, an optional adhesive layer, an optional hole blocking layer, a charge generating layer, a charge transport layer, and, in some embodiments, an anti-curl backing layer. It is preferred that the photoconductive imaging member employed in the present invention be infrared sensitive this allows improved transmittance through cyan image. Belt 100 is charged by charging unit 101*a*. Raster output scanner (ROS) 20*a*, controlled by image processing unit 44, writes a first complementary color image bitmap information by selectively erasing charges on the belt 100. The ROS 20*a* writes the image information pixel by pixel in a line screen registration mode. It should be noted that either discharged area development (DAD) can be employed in which discharged portions are developed or charged area development (CAD) can be employed in which the charged portions are developed with toner. After the electrostatic latent image has been recorded, belt 100 advances the electrostatic latent image to development station 103*a*. At development station 103*a*, roller 11, rotating in the direction of arrow 12, advances a liquid developer material 13*a* from the chamber of housing 13*a* to development zone 17*a*. An electrode 16*a* positioned before the entrance to development zone 17*a* is electrically biased to generate an AC field just prior to the entrance to development zone 17*a* so as to disperse the toner particles substantially uniformly throughout the liquid carrier. The toner particles, disseminated through the liquid carrier, pass by electrophoresis to the electrostatic latent image. The charge of the toner particles is opposite in polarity to the charge on the photoconductive surface.

The liquid developers suitable for the present invention generally comprise a liquid vehicle, toner particles, a charge control additive. The liquid medium may be any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, available from Exxon Corporation, and including isoparaffinic hydrocarbons such as Isopar® G, H, L, and M, available from Exxon Corporation, Amsco® 460 Solvent, Amsco® OMS, available from American Mineral Spirits Company, Soltroi®, available from Phillips Petroleum Company, Pagasol®, available from Mobil Oil Corporation, Shellsol®, available from Shell Oil Company, and the like. Isoparaffinic hydrocarbons are preferred liquid media, since they are colorless, environmentally safe, and possess a sufficiently high vapor pressure so that a thin film of the liquid evaporates from the contacting surface within seconds at ambient temperatures. Generally, the liquid medium is present in a large amount in the developer composition, and constitutes that percentage by weight of the developer not accounted for by the other components. The liquid medium is usually present in an amount of from about 80 to about 98 percent by weight, although this amount may vary from this range provided that the objectives of the present invention are achieved.

The toner particles can be any colored particle compatible with the liquid medium, such as those contained in the developers disclosed, for example, in U.S. Pat. Nos. 3,729,419; 3,841,893; 3,968,044; 4,476,210; 4,707,429; 4,762,764; and 4,794,651; and U.S. application Ser. No. 08/268,608 the disclosures of each of which are totally incorporated herein by reference. The toner particles can consist solely of pigment particles, or may comprise a resin and a pigment; a resin and a dye; or a resin, a pigment, and a dye. Suitable resins include poly(ethyl acrylate-co-vinyl pyrrolidone), poly(N-vinyl-2-pyrrolidone), and the like. Other examples of suitable resins are disclosed in U.S. Pat. No. 4,476,210, the disclosure of which is totally incorporated herein by reference. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, all available from Sandoz Company, Mississauga, Ontario, and the like. Dyes generally are present in an amount of from about 5 to about 30 percent by weight of the toner particle, although other amounts may be present provided that the objectives of the present invention are achieved. Suitable pigment materials include carbon blacks such as Microlith® CT, available from BASF, Printex® 140 V, available from Degussa, Raven® 5250 and Raven® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that it combines well with any polymeric material also included in the developer composition. Pigment particles are generally present in amounts of from about 5 to about 40 percent by weight of the toner particles, and preferably from about 10 to about 30 percent by weight. The toner particles should have an average particle diameter from about 0.2 to about 10 microns, and preferably from about 0.5 to about 2 microns. The toner particles may be present in amounts of from about 1 to about 10, and preferably from about 2 to about 4 percent by weight of the developer composition.

Examples of suitable charge control agents include lecithin (Fisher Inc.); OLOA 1200, a polyisobutylene succinimide available from Chevron Chemical Company; basic barium petronate (Witco Inc.); zirconium octoate (Nuodex); aluminum stearate; salts of calcium, manganese, magnesium and zinc; heptanoic acid; salts of barium, aluminum, cobalt, manganese, zinc, cerium, and zirconium octoates; salts of barium, aluminum, zinc, copper, lead, and iron with stearic acid; and the like. The charge control additive may be present in an amount of from about 0.01 to about 3 percent by weight, and preferably from about 0.02 to about 0.05 percent by weight of the developer composition.

After the image is developed it is conditioned at development station 103*a*. Development station 103*a* also includes porous roller 18*a* having perforations through the roller skin covering. Roller 18*a* receives the developed image on belt 100 and conditions the image by reducing fluid content while inhibiting the departure of toner particles from the image, and by compacting the toner particles of the image. Thus, an increase in percent solids is provided to the developed image, thereby improving the quality of the developed image. Preferrably, the percent solids in the developed image is increased to more than increased to 20 percent solids. Porous roller 18*a* operates in conjunction with vacuum (not shown) for removal of liquid from the roller. A roller (not shown), in pressure against the blotter roller 18*a*, may be used in conjunction with or in the place of the vacuum, to squeeze the absorbed liquid carrier from the blotter roller for deposit into a receptacle. Furthermore, the vacuum assisted liquid absorbing roller may also find useful application where the vacuum assisted liquid absorbing roller is in the form of a belt, whereby excess liquid carrier is absorbed through an absorbent foam layer. A belt used for collecting excess liquid from a region of liquid developed images is described in U.S. Pat. Nos. 4,299,902 and 4,258,115, the relevant portions of which are hereby incorporated by reference herein.

In operation, roller 18 rotates in direction of the arrow to impose against the "wet" image on belt 100. The porous body of roller 18 absorbs excess liquid from the surface of the image through the skin covering pores and perforations. Vacuum (not shown) located on one end of the central cavity of the roller, draws liquid that has permeated through roller 18 out through the cavity and deposits the liquid in a receptacle or some other location which will allow for either disposal or recirculation of the liquid carrier. Porous roller 18, discharged of excess liquid, continues to rotate to provide a continuous absorption of liquid from image on belt 100. The image on belt 100 advances to lamp 34*a* where any residual charge left on the photoconductive surface is extinguished by flooding the photoconductive surface with light from lamp 34*a*.

The development takes place for the second color for example magenta, as follows: the developed latent image on belt 100 is recharged with charging unit 100*a*. The developed latent image is re-exposed by ROS 20*b*. ROS 20*b* superimposing a second color image bitmap information over the previous developed latent image. Preferrably, for each subsequent exposure an adaptive exposure processor is employed that modulates the exposure level of the raster output scanner (ROS) for a given pixel as a function of toner previously developed at the pixel site, thereby allowing toner layers to be made independent of each other, as described in U.S. application Ser. No. 07/927,751 the relevant portions of which are hereby incorporated by reference herein. Also, during subsequent exposure, the image is re-exposed in a line screen registration oriented along the process or slow scan direction. This orientation reduces motion quality errors and allows the utilization of near perfect transverse registration. At development station B, roller 166, rotating in the direction of arrow 12, advances a liquid developer material 13 from the chamber of housing 14 to development zone 17*b*. An electrode 16*b* positioned before the entrance to development zone 17 is electrically biased to generate an AC field just prior to the entrance to development zone 17*b* so as to disperse the toner particles substantially uniformly throughout the liquid carrier. The toner particles, disseminated through the liquid carrier, pass by electrophoresis to the previous developed image. The charge of the toner particles is opposite in polarity to the charge on the previous developed image. Roller 18*b* receives the developed image on belt 100 and conditions the image by reducing fluid content while inhibiting the departure of toner particles from the image, and by compacting the toner particles of the image. Preferrably, the percent solids is more than 20 percent, however, the percent of solids can range between 15 percent and 40 percent. The image on belt 100 advances to lamps 34*b* where any residual charge left on the photoconductive surface is extinguished by flooding the photoconductive surface with light from lamp 34.

The development takes place for the third color for example cyan as follows: the developed latent image on belt 100 is recharged with charging unit 100*b*. The developed latent image is re-exposed by ROS 20*c*. ROS 20 superimposing a third color image bitmap information over the previous developed latent image. At development station 103*c*, roller 11, rotating in the direction of arrow 12, advances a liquid developer material 13*c* from the chamber of housing 14 to development zone 17*c*. The toner particles, disseminated through the liquid carrier, pass by electrophoresis to the previous developed image. Roller 18*c* receives the developed image on belt 100 and conditions the image by reducing fluid content so that the image has 20 percent solids, however, the percent of solids can range between 15 percent and 40 percent. The image on belt 100 advances to lamps 34 where any residual charge left on the photoconductive surface is extinguished by flooding the photoconductive surface with light from lamp 34.

The resultant image, a multi layer image by virtue of the developing station 103*a*, 103*b*, 103*c* and 103*d* having black, yellow, magenta, and cyan, toner disposed therein advances to the intermediate transfer station. It should be evident to one skilled in the art that the color of toner at each development station could be in a different arrangement. The resultant image is electrostatically transferred to the intermediate member by charging device 111. The present invention takes advantage of the dimensional stability of the intermediate member to provide a uniform image deposition stage, resulting in a controlled image transfer gap and better image registration. Further advantages include reduced heating of the recording sheet as a result of the toner or marking particles being premelted, as well as the elimination of electrostatic transfer of charged particles to a recording sheet. Intermediate member 110 may be either a rigid roll or an endless belt having a path defined by a plurality of rollers in contact with the inner surface thereof. It is preferred that intermediate member comprises a two layer structure in which the substrate layer has a thickness greater than 0.1 mm and a resistivity of $10^6$ ohm-cm. A insulating top layer has a thickness less than 10 micron, a dielectric constant of 10, and a resistivity of $10^{13}$ ohm-cm. The top layer also has an adhesive release surface. Also, it is preferred that both layers have matching hardness less than 60 durometer. Preferably, both layer are composed of Viton™ (a fluoroelastomer of vinylidene fluoride and hexafluoropropylene) which can be laminated together. The multi layer image is conditioned by blotter roller 120 which receives the multi level image on intermediate member 110 and conditions the image by reducing fluid content while inhibiting the departure of toner particles from the image, and by compacting the toner particles of the image. Blotter roller 120 conditions the multi layer so that the image has a toner composition of more than 50 percent solids.

Subsequently, multi layer image, present on the surface of the intermediate member, is advanced through image liquefaction stage B. Within stage B, which essentially encompasses the region between when the toner particles contact the surface of member 110 and when they are transferred to recording sheet 26, the particles are transformed into a tackified or molten state by heat which is applied to member 110 internally. Preferably, the tackified toner particle image is transferred, and bonded, to recording sheet 26 with limited wicking by the sheet. More specifically, stage B includes a heating element 32, which not only heats the external wall of the intermediate member in the region of transfix nip 34, but because of the mass and thermal conductivity of the intermediate member, generally maintains the outer wall of member 110 at a temperature sufficient to cause the toner particles present on the surface to melt. The toner particles on the surface, while softening and coalescing due to the application of heat from the exterior of member 110, maintain the position in which they were deposited on the outer surface of member 110, so as not to alter the image pattern which they represent. The member continues to advance in the direction of arrow 22 until the tackified toner particles, 30, reach transfixing stage C. At transfix nip 34, the liquefied toner particles are forced, by a normal force N applied through backup pressure roll 36, into contact with the surface of recording sheet 26. Moreover, recording sheet 26 may have a previously transferred toner image present on a surface thereof as the result of a prior imaging operation, i.e. duplexing. The normal force N, produces a nip pressure which is preferably about 100 psi, and may also be applied to the recording sheet via a resilient blade or similar spring-like member uniformly biased against the outer surface of the intermediate member across its width.

As the recording sheet passes through the transfix nip the tackified toner particles wet the surface of the recording sheet, and due to greater attractive forces between the paper and the tackified particles, as compared to the attraction between the tackified particles and the liquid-phobic surface of member 110, the tackified particles are completely transferred to the recording sheet as image marks. Furthermore, as the image marks were transferred to recording sheet 26 in a tackified state, they become permanent once they are advanced past transfix nip and allowed to cool below their melting temperature. The transfixing of tackified marking particles has the further advantage of only using heat to pre-melt the marking particles, as opposed to conventional heated-roll fusing systems which must not only heat the marking particles, but the recording substrate on which they are present.

After the developed image is transferred to intermediate member 110, residual liquid developer material remains adhering to the photoconductive surface of belt 100. A cleaning roller 31 formed of any appropriate synthetic resin, is driven in a direction opposite to the direction of movement of belt 100 to scrub the photoconductive surface clean. It is understood, however, that a number of photoconductor cleaning means exist in the art, any of which would be suitable for use with the present invention. Any residual charge left on the photoconductive surface is extinguished by flooding the photoconductive surface with light from lamp 34*d*.

It is, therefore, evident that there has been provided, in accordance with the present invention, a full color, high speed printing machine that fully satisfies the aims and advantages hereinbefore set forth. While this invention has been described in conjunction with one embodiment thereof, it is evident-that many alternatives, modifications and variations will be apparent to those skilled in the art. Accordingly, it is intended to embrace all such alternatives, modification and variations as fall within the spirit and broad scope of the appended claims.

We claim:

1. An electrophotographic printing machine for producing a color image on a recording sheet, comprising:

a photoconductive member;

first means for charging the photoconductive member;

first means for exposing the charged photoconductive member for recording an electrostatic latent image thereon;

first means for developing the electrostatic latent image with liquid developer material containing toner particles of a first color to form a developed image on said photoconductive member;

first means for conditioning the developed image by reducing fluid content while inhibiting the departure of toner particles therefrom thereby increasing solids content of the developed image on said photoconductive member, said first condition means increase the solids content of the developed image so that the developed image has a solids content of about 15 to 40 percent, but preferably about 20 percent;

second means for charging the developed image on said photoconductive member;

second means for exposing the charged developed image on said photoconductive member; and second means for developing the developed image with liquid developer material containing toner particles of a second color to form a composite image on said photoconductive member.

2. The electrophotographic printing machine of claim 1, further comprising:

second means for conditioning the composite image by reducing fluid content while inhibiting the departure of toner particles therefrom thereby increasing solids content of the composite image on said photoconductive member.

3. The electrophotographic printing machine of claim 2, further comprising:

an intermediate member;

means for transferring the composite image from the photoconductive member to said intermediate member; and third means for conditioning the composite image by reducing fluid content while inhibiting the departure of toner particles therefrom thereby increasing solids content to the composite image on said intermediate member.

4. The electrophotographic printing machine of claim 3, further comprising:

a heater, in communication with an outer surface of said intermediate member, for heating said intermediate member so as to cause the tackification of the toner particles of the composite image on the outer surface thereof; and means, defining a nip with the outer surface of said intermediate member, for transferring the tackified toner particles of the composite image to the recording sheet passing through the nip defined by said intermediate member and said second transferring means, whereby the tackified toner particles of the composite image is cooled upon contact with the recording sheet to become permanently fixed to the surface of the recording sheet.

5. The electrophotographic printing machine of claim 1, wherein said liquid developer material comprises a liquid vehicle, toner particles, and a charge control additive.

6. The electrophotographic printing machine of claim 2, wherein said first condition means increase the solids content of the developed image so that the developed image has a solids content of about 15 to 40 percent, but preferably about 20 percent.

7. The electrophotographic printing machine of claim 2, wherein said second condition means increase the solids content of the composite image so that the developed image has a solids content of about 15 to 40 percent, but preferably about 20 percent.

8. The electrophotographic printing machine of claim 3, wherein said third condition means increase the solids content of the composite image so that the developed image has a solids content of about 40 to 60 percent, but preferably about 50 percent.

* * * * *